United States Patent [19]

Terlecky

[11] Patent Number: 4,817,535

[45] Date of Patent: Apr. 4, 1989

[54] STAND ALONE WELL CAR WITH DOUBLE AXLE SUSPENSION SYSTEM

[75] Inventor: Boris S. Terlecky, Woodridge, Ill.

[73] Assignee: Trailer Train Company, Chicago, Ill.

[21] Appl. No.: 946,054

[22] Filed: Dec. 24, 1986

[51] Int. Cl.[4] ..... B61F 5/24

[52] U.S. Cl. ..... 105/158.2; 105/171; 105/179; 105/199.1; 105/222

[58] Field of Search ..... 105/157.1, 182.1, 190.1, 105/190.2, 199.1, 199.5, 222, 453, 244, 158.1, 158.2, 171, 179; 188/381

[56] References Cited

U.S. PATENT DOCUMENTS

| | | | |
|---|---|---|---|
| 3,638,582 | 2/1972 | Beebe | 105/222 X |
| 3,952,669 | 4/1976 | Mauzin | 105/199.1 X |
| 4,067,261 | 1/1978 | Scheffel | 105/199.1 X |
| 4,408,542 | 10/1983 | Heap | 105/244 X |
| 4,533,126 | 8/1985 | Mueller | 188/381 X |
| 4,561,360 | 12/1985 | Mulcahy | 105/218.1 X |
| 4,583,464 | 4/1986 | Harwood | 105/222 X |
| 4,674,411 | 5/1987 | Schindehutte | 105/199.3 X |

FOREIGN PATENT DOCUMENTS

| | | | |
|---|---|---|---|
| 1302598 | 7/1962 | France | 188/381 |
| 404975 | 10/1973 | U.S.S.R. | 188/381 |
| 4433 of 1875 | | United Kingdom | 105/453 |

*Primary Examiner*—Robert B. Reeves
*Assistant Examiner*—Frank Williams
*Attorney, Agent, or Firm*—Kinzer, Plyer, Dorn, McEachran & Jambor

[57] ABSTRACT

A stand alone double stack railroad well car for carrying stacked containers is disclosed. The car includes a platform suspended at each end upon swing hangers from a multiple axle truck or suspension system, utilizing leaf springs. Adjacent axles are connected by bridging beams which are pivotally connected to the leaf springs. Shear pads connected between the bridging beams and axles permit limited angular displacement of the axles relative to each other. Axle guards are provided for limiting lateral movement of the car relative to the trucks. An axle guard frame assembly is rotatably connected to the underside of the car body or platform at each end. It includes vertical axle guards which engage the axle bearing adapter housings to limit lateral movement. The rotatable connection of the axle guard frame assembly on the underside of the carbody permits limited rotational or pivotal movement of the axle guard frame as the suspension system negotiates a curve in the track.

11 Claims, 5 Drawing Sheets

10
112
114
113
14
116
130
110
12
128
16
28
28
122
131
126
132
134
4
4
122
22
24
30
18
50
48
20
3
3
113
118
120
112

113
116
118
112
10
120
14
130
131
114
50
18
20
124
122
24
46
42
48
46
42
44
44
44
44
11
11
122
54
54
22
20
16
40
30
26
30
40
22

Fig. 5.
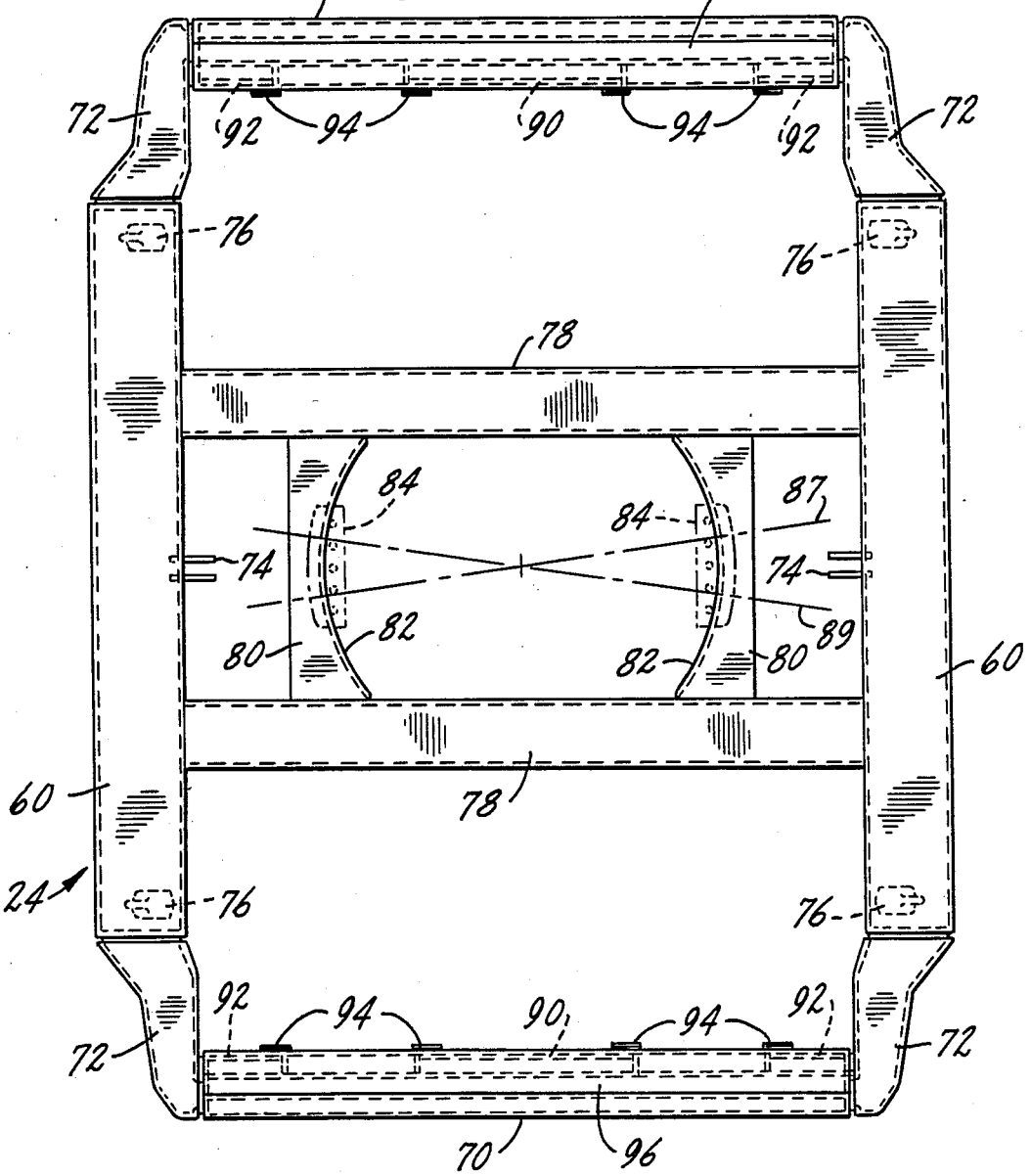
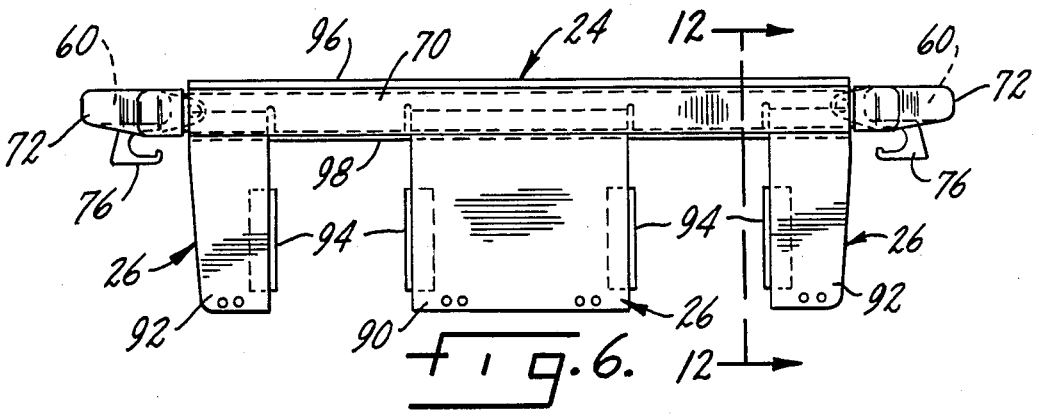
Fig. 6.

112
113
14
130
10
12
24
22
16
110
28
78
22
28
48
50
20
30
52
30
18
112
20
113

113
118
130

14
112
10
120
114
50
18
110
124
122
46
48
46
60
122
54
44
20
20
54
40
22
16

STAND ALONE WELL CAR WITH DOUBLE AXLE SUSPENSION SYSTEM

BACKGROUND OF THE INVENTION

This invention relates generally to railroad cars and to a suspension system for railroad cars. More particularly it relates to a new well car for carrying container freight and to its suspension systems which includes a double axle arrangement for supporting the car on railroad tracks.

Double axle trucks have enjoyed long use in the railroad industry. The typical double axle truck has side frames mounted at the ends of the two axles, bridging the axles. A bolster extends between the centers of the side frames. Coil springs are disposed between the bolster and each side frame. The center of the bolster has a center plate.

The underside of a carbody has a center bearing at each truck location. The truck and carbody are rotatably connected at the underside of the railroad car through the center plate and bearing. The weight of the ca is transferred through the center plate and bearing to the bolster and ultimately through the springs and side frames to the axles and their associated wheels. When the railroad car negotiates a curve, the entire truck rotates with respect to a vertical axis about the center plate and bearing.

Single axle trucks are also known. With such arrangements, a single wheeled axle is provided at each end of the car body. A suspension system, which typically includes leaf springs and swing hangers connected between the underside of the car and the axle, transmits the load to the rail and permits negotiation of curved track sections. One such single axle truck is disclosed in U.S. patent application Ser. No. 733,905, filed May 14, 1985, in the names of Rene H. Brodeur and Boris S. Terlecky and Ronald P. Sellberg and assigned to the assignee of this application. The disclosure of that application is incorporated herein by reference.

Recently, container freight has become a significant revenue source. Freight containers typically have a standard width and height, and a range of lengths. As a result of increased use of containers, a need has arisen to maximize the container loading capacity of railroad cars. To this end, the well car has been utilized in which containers are stacked, one upon the other. Typically, the car contains a well disposed centrally of the car body. The well has no underlying center sill, and thus may be deep and relatively close to the track. Containers may be stacked in the well, and the car may accommodate two stacked containers, each over nine feet high, and yet maintain necessary tunnel clearances. Typically the wells are sized to carry the largest containers which are up to 48 feet in length.

It has been found that the load requirements of double stacked containers, particularly those of 48 feet length, exceed the load carrying capacity of typical single axle trucks. Double axle trucks, such as those previously described, do provide the requisite load carrying capacity. Such trucks, however, are very heavy, and thus adversely affect fuel economy and loading capacity.

Articulated truck arrangements have been employed in which adjacent platforms share a single truck. The attendant disadvantages of articulated platforms are, however, an undesirable aspect of such arrangements. Multiple platforms operate as a unit which requires selective loading procedures. Maintenance and repair requirements also involve removing multiple platforms from service with resultant reduction in revenue.

The present invention is directed to a well car and its suspension systems that is a "stand-alone" platform as opposed to a multiple platform or articulated car It is intended to carry two stacked containers. The car includes the unique suspension system which solves the problems associated with prior known single or double axle truck arrangements for a car of this type and capacity.

The present invention provides a railroad freight car with a double axle suspension system. The car is a stand-alone well car. It includes a central well adapted to receive a pair of containers, one stacked upon the other. The well is depressed to minimize overall height of the loaded car.

The suspension system of the present invention is of the double axle type connected to the car through leaf springs and swing hangers which are pivotally connected to the underside of the carbody and swing longitudinally of the car. The leaf springs are pivotally connected to beams which bridge the ends of adjacent axles. When the car negotiates a curve, the swing hangers pivot. Pivotal movement of the axles with respect to the car to negotiate a curve is accommodated by the relative pivotal movement of the beams and leaf springs and the pivotal action of the swing hangers which permit longitudinal displacement of the carbody relative to the suspension system.

Shear pad assemblies connect the beams to the axles. These shear pad assemblies permit limited angular displacement of the axes of the axles relative to each other. This further facilitates negotiating a curve.

An axle guard frame assembly is rotatably suspended from the underside of the car. It includes vertical axle guards which limit lateral movement of the carbody relative to the axle bearing adapter housings. The axle guard frame assembly and its depending axle guards limit lateral movement of the carbody with respect to the wheels, both in straight and curved sections of track. Its connection to the underside of the car body defines a pivot point for the suspension system.

SUMMARY OF THE INVENTION

Accordingly, in one aspect, the present invention provides a suspension system for a railroad car which includes double axles. The system is connected to each end of car by leaf springs and swing hangers.

Each truck or suspension system includes a pair of axles disposed transversely to the carbody. The axles are adjacent each other, and each includes a pair of rail-engaging wheels. Adjacent axles are connected by bridge beams. Shear pads connect the bridge beams to the axle bearing housings.

The bridge beams are each connected to leaf springs disposed parallel to the longitudinal axis of the carbody, one adjacent each side sill. The leaf springs are pivotally connected at their ends to swing hangers, which in turn are pivotally connected to the car body. Thus, the carbody is suspended upon the truck or suspension system at both ends of the car on pairs of leaf springs.

When the car negotiates a curve, the wheels and axles of the suspension system turn or pivot relative to the longitudinal axis of the car as a result of the longitudinal pivotal movement of the swing hangers. The bridge beams also pivot with respect to the leaf springs. The shear pads connecting the bridge beams to the axles also permit limited movement of each axle of each pair with respect to the other.

In another aspect the present invention provides means for limiting lateral movement of the railroad carbody relative to the suspension system. The limiting means comprises an axle guard frame rotatably suspended from the car so that the frame may pivot with the rotation of the truck relative to the carbody. The frame has a plurality of spaced, vertical axle guards or plates depending therefrom adjacent each axle bearing adapter housing. Each bearing adapter housing includes axle guard engaging means which limits longitudinal movement of the carbody relative to the axles.

Another aspect of the present invention provides a stand-alone double stack, well car for carrying containers which incorporates a unique double axle suspension system at each end of the car.

BRIEF DESCRIPTION OF THE DRAWINGS

FIG. 5 is a top view of the axle guard frame and suspension system of FIG. 1.

FIG. 6 is a side view of the axle guard frame of FIG. 5.

DESCRIPTION OF THE PREFERRED EMBODIMENTS

Figure 1:
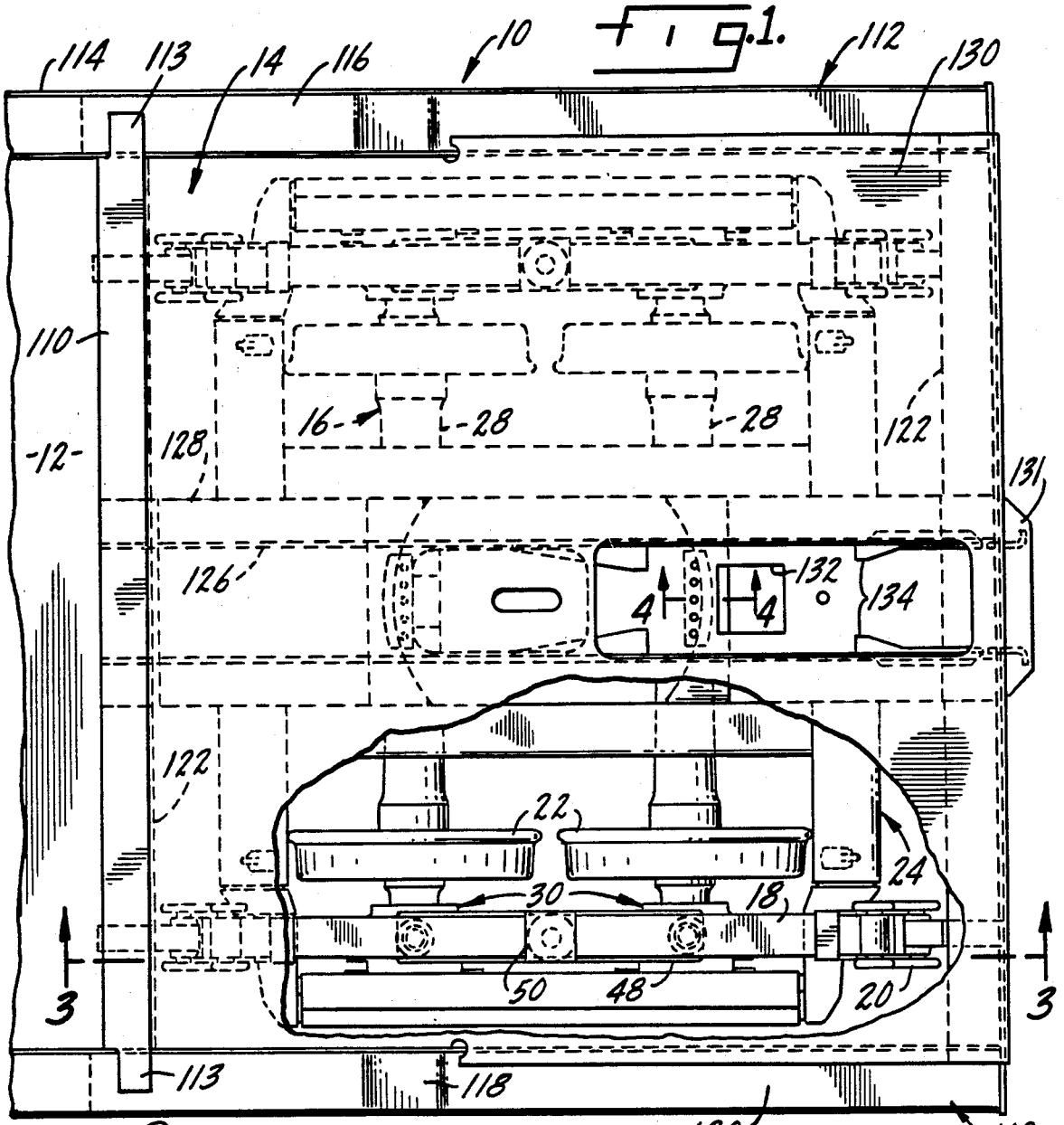
FIG. 1 is a top view of an end section of a railroad car constructed according to the present invention, with a portion broken away illustrating the suspension system of the present invention.

In the accompanying drawings there is illustrated a railroad car embodying the principles of the present invention. The car of the illustrated embodiment is a unique stand-alone well car having a unique double axle suspension arrangement. This car is adapted to carry containers within the well and is particularly useful in carrying double-stacked containers. The illustrated car can carry two stacked containers, each container measuring up to 40 feet, 45 feet, or 48 feet long, and over 9 feet high. It is particularly useful for handling large, heavy loads while providing the advantages of stand alone cars, and a lighter weight suspension system or truck than a standard two axle truck.

Generally, the illustrated well car 10 has a longitudinally extending well 12, and end sections 14 at each end of the well 12. The car is comprised of structural side sills 112 and cross members 110.

The well car is supported at each end by a double axle suspension system generally designated 16. Parabolic leaf springs 18 connect the system 16 to the carbody through swing hangers 20.

The system 16 of the illustrated embodiment includes four rail-engaging wheels 22 at each end 14. An axle guard frame 24 at each end is adapted to pivot relative to the carbody so as to follow the movement of the system. Axle guard frame 24 includes a plurality of vertical axle guards 26 which limit lateral movement of the carbody with respect to the wheels, as will be explained. The suspension system and axle guard frames are substantially the same at each end of the car, so a description of one will therefore be given. It should be noted that the suspension system is considered to be inventive apart from the disclosed well car. The suspension system will have application in a wide variety of railroad cars.

It should also be noted that the axles, wheels, swing hangers, springs, adaptor housings and axle guards are components of a single axle truck or suspension system such as is illustrated in said application for U.S. patent Ser. No. 733,905, filed May 14, 1985. The content of that application is incorporated herein by reference as if fully recited herein.

Figure 3:
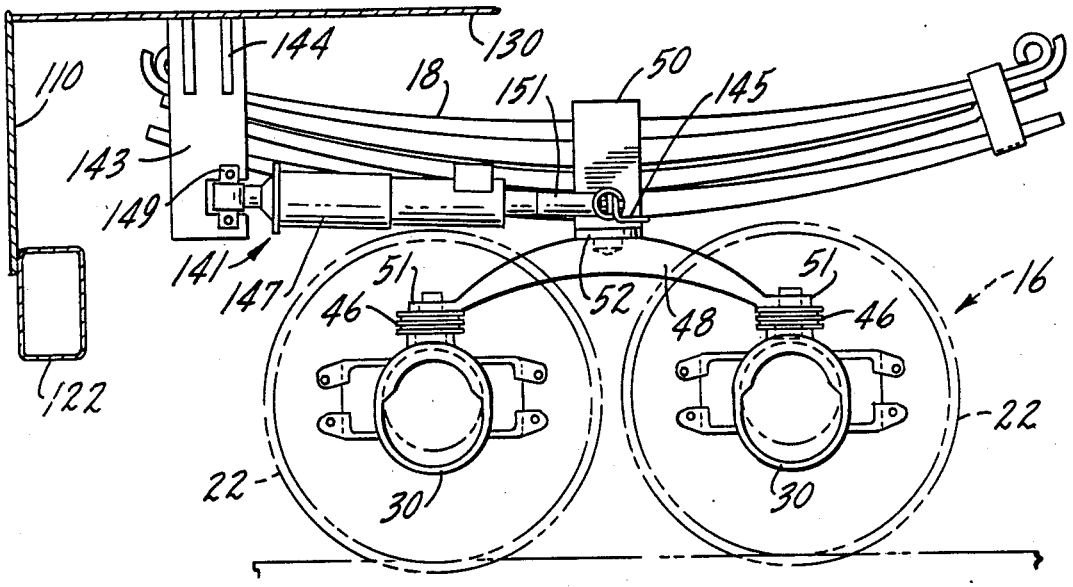
FIG. 3 is a fragmentary sectional view of the railroad car of FIG. 1, taken along line 3—3 of FIG. 1.
Figure 12:
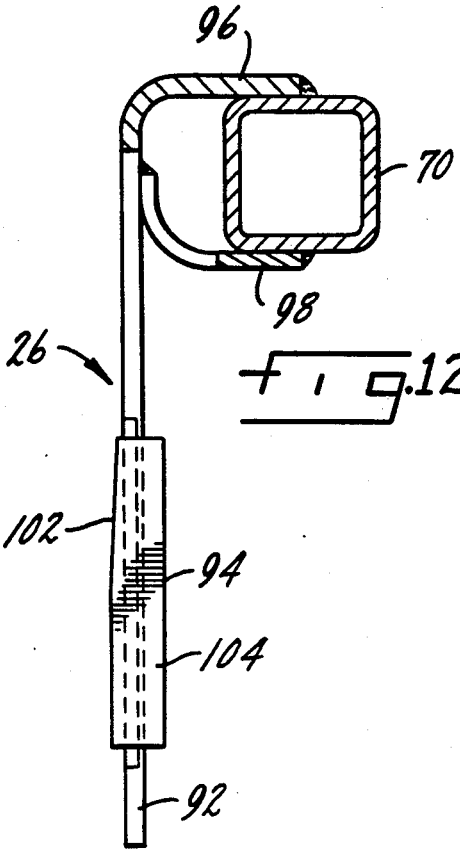
FIG. 12 is a fragmentary view, partially in section of another portion of the apparatus of FIG. 1 taken along the line 12—12 of FIG. 6.

As shown in FIG. 1, each suspension system 16 includes two parallel axles 28 extending transversely relative to the longitudinal axis of the carbody. Of course, more than two axles could be employed if desired. Each axle 28 has a pair of rail-engaging wheels 22 at its ends. As shown in FIGS. 1 and 3, bearing housings 30 are disposed at opposite ends of each axle 28. Each bearing housing encloses a roller bearing device 40 which rotatably supports the axle and wheel. Each bearing housing 30 also includes an integral adaptor housing 42. Each adaptor housing includes vertical surfaces 41 and outwardly spaced longitudinally extending flanges 44 disposed o either side of the adaptor housing, one on each side of the centerline of the associated axle. Each adaptor housing 42 defines with surfaces 41 and the associated flanges 44 spaced planar vertical surfaces as best seen in FIG. 12. Thus surfaces 41 of adaptor housings 42 and flanges 44 define spaces on either side of each axle within which an axle guard 26 is captured as will be explained. The space are large enough to permit limited lateral and longitudinal movement of axle guards 26 relative to adaptor housings 42 before they abut the adaptor housing to stop the lateral and longitudinal movement of the carbody relative to the wheels and axles. The structure of the adaptor housings 42 and flanges 44 is substantially the same as that disclosed in the aforementioned U.S. patent application Ser. No. 733,905.

Figure 2:
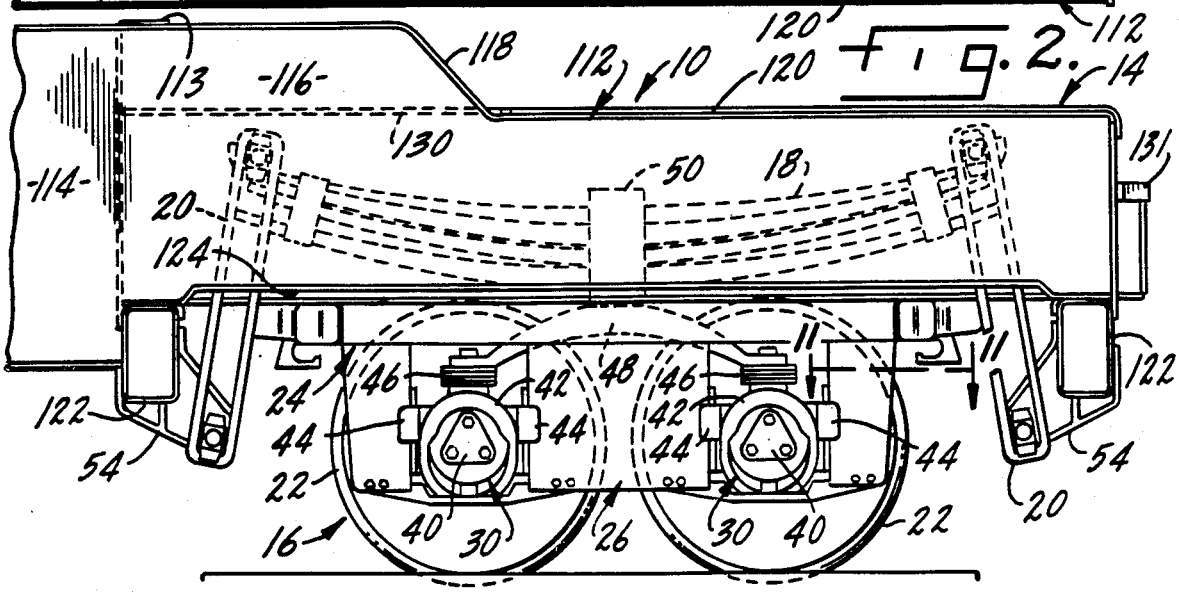
FIG. 2 is a side elevational view of the end section of the railroad car and suspension system of FIG. 1.

As shown in FIGS. 2 and 3, equalizer beams 48 bridge housings 42 of adjacent axles and join the associated bearing adapter housings. Thus, each suspension assembly at each car end has two equalizer beams 48, one below each side sill 112, connecting adjacent axles 28.

Equalizer beams 48 may be made, for example, of hardened and tempered steel. In the illustrated embodiment, each equalizer beam has a general parabolic shape and includes a generally flattened center section 43 and integral sides 45 tapering downwardly from the center section to end sections 51, which are generally flattened. Each end section has a vertical bore therein.

Figure 8:
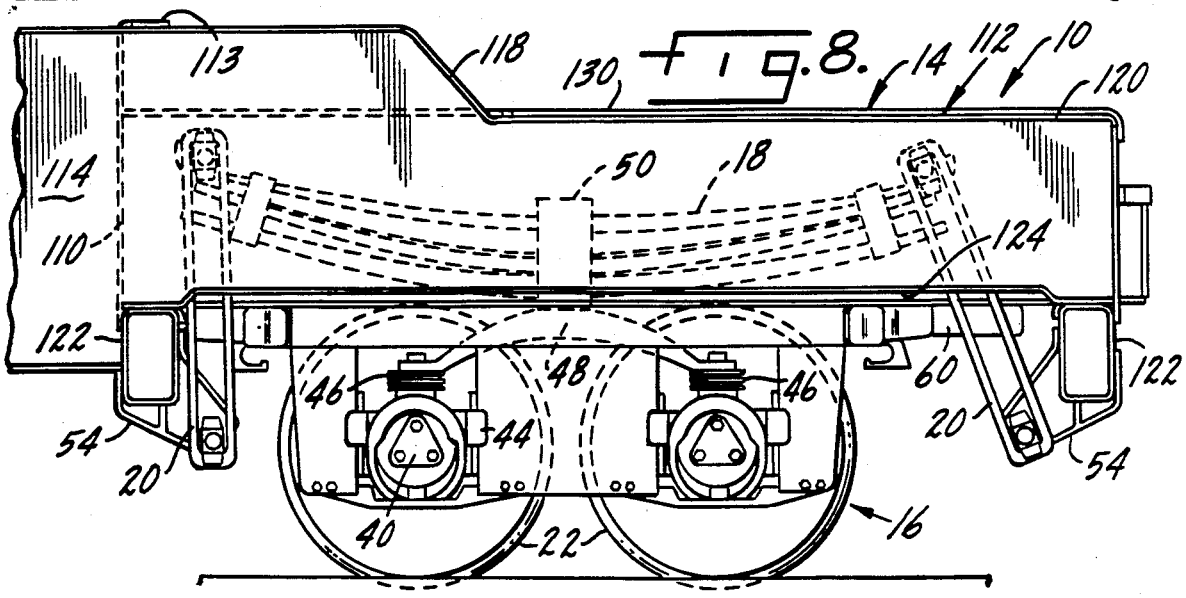
FIG. 8 is a side view of the end section of the railroad car, as illustrated in FIG. 7.
Figure 10:
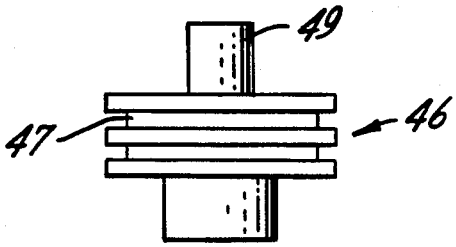
FIG. 10 is a partial view, on an enlarged scale, of a portion of the apparatus illustrated in FIG. 3.

As shown in FIGS. 2, 3 and 8 a shear pad assembly 46 extends upwardly from each adaptor housing 42. Referring to FIG. 10, each shear pad assembly 46 includes an alternate array of a plurality of horizontal steel plates or discs separated by layers of elastomeric pads 47, such as natural rubber, which are adhered to the adjacent plates. Such pads permit shearing movement of the shear pad assembly laterally, which, as will be explained, will improve the wear and curving performance of the suspension system. Each shear pad assembly 46 includes a vertically extending pin 49 which engages within a bore of one flattened end of an equalizer beam 48. Acceptable pads are available from the Lord Corporation of Erie, Pa., Part No. J-18775-1. The center section 43 of each equalizer beam 48 is machined to receive a vertical pin on a spring buckle 50 on each spring 18. A bearing 52 in the form of an annular disc of brass or other low friction material may be disposed between the buckle 50 and equalizer beam 48, to accommodate pivotal movement with respect to buckle 50 in a horizontal plane.

Buckles 50 fix the mid-section of parabolic leaf spring 18 to equalizer beam 48. Each end of leaf spring 18 is pivotally connected to one end of one swing hanger 20, the other end of which is pivotally connected to a connector frame 54 connected to the underside of the carbody.

One leaf spring 18 is disposed above each equalizer beam 48, so that there is one leaf spring on each side of each double axle suspension assembly. The leaf springs are disposed parallel to the longitudinal centerline of the car 10 and do not rotate with respect to the carbody. The swing hangers are arranged such that the pivotal connection to the connectors 54 and to the leaf springs 18 permit movement of the springs in a direction parallel to the longitudinal centerline of the carbody.

Figure 7:
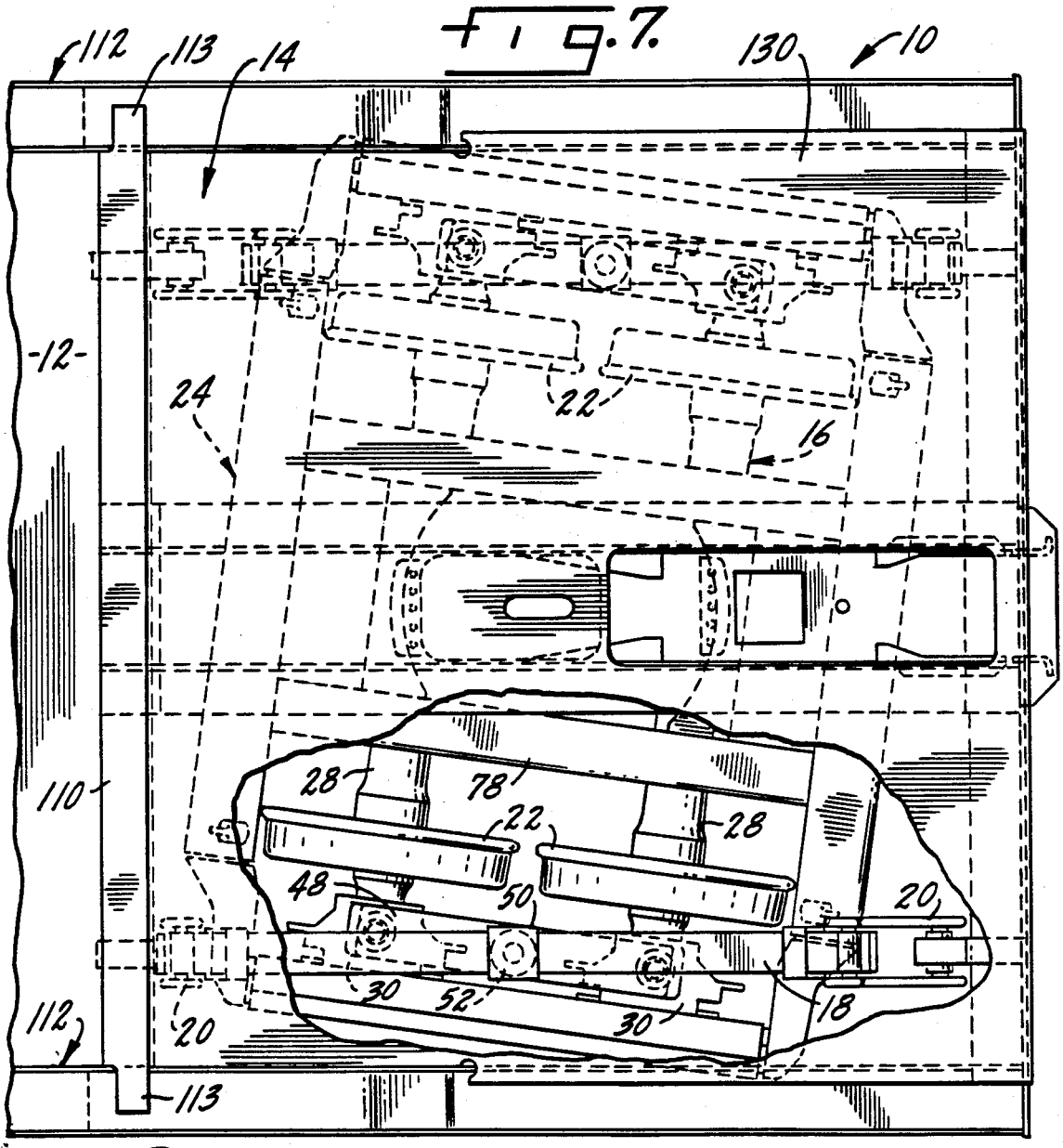
FIG. 7 is a top view of the end section of the railroad car of FIG. 1, illustrating the position of the components of the suspension system as the car negotiates a curved track.

The above-described construction of the double axle suspension allows the entire carbody to be suspended on front and rear double axle suspension systems or trucks. This construction allows the wheels, axles, and beams to turn with respect to the car body as the car negotiates a curve in the rails by virtue of the longitudinal movement permitted by the swing hangers. As shown in FIGS. 7 and 8, as the wheels 22 follow the curve of the rails, the wheels 22, axles 28, bearing housings 30, and equalizer beams 48 all turn or pivot from a position parallel to the longitudinal centerline of the car and follow the track curve. The equalizer beams 48 rotate or pivot horizontally with respect to the buckles 50 of the leaf springs 18, but the leaf springs 18 and swing hangers 20 remain parallel to the longitudinal axis of the carbody though they move longitudinally. On one side the turning wheels force the swing hangers forwardly of the carbody, while on the other side they force the swing hangers rearwardly with respect to the carbody. The swing hangers, wheels and axles are forced back to the neutral position, shown in FIG. 1, by the weight of the car when the rails are no longer curved.

As shown in FIG. 7, when the wheels turn, the axle guard frame 24 rotates or pivots horizontally. This movement accommodates the relative rotational disposition of the axles relative to the car longitudinal centerline while maintaining the axle guards 26 in proper operative relationship to the bearing adapters 42.

As shown in FIGS. 5 and 6, the axle guard frame 24 is a fabricated steel assembly and includes spaced transverse tubes 60 and spaced longitudinal tubes 70 connected at their ends as by welding to four corner castings 72. Transverse tubes 60 carry lever supports 74, brake hangers 76 and a pair of spaced longitudinal spreaders 78 which extend between the transverse tubes 60.

Opposing bearing plates 80 are connected between spreaders 78. Plates 80 are steel and are spaced from each other, equidistant from the center of frame 24. They may be welded to spreaders 78. The inner edges 82 of the plates, facing the center of the frame, are curved and form a partial semi-circular opening defined by edges 82.

Figure 4:
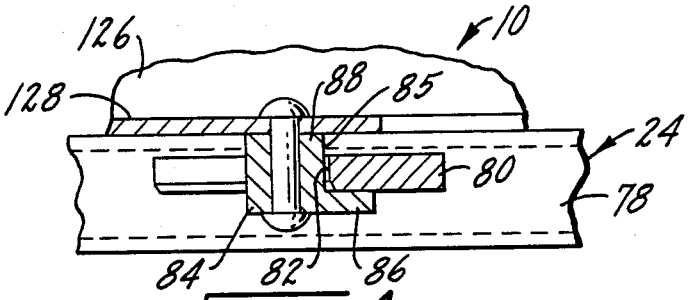
FIG. 4 is a fragmentary sectional view, taken along line 4—4 of FIG. 1, showing the connection of the axle guard frame of the suspension system to the carbody.

As shown in FIGS. 4 and 5, the inner edge 82 of each bearing plate 80 is carried on a partially semi-circular frame bearing 84 connected to the underside of the carbody. The frame bearings may be made, for example, of cast steel ASTM A-148 Grade 90-60. Frame bearings 84 are spaced equidistant from the center of frame 24 and define partial semi-circular surfaces 85 which as illustrated in FIG. 4 are received in the openings defined by edges 82. Each frame bearing 84 is generally L-shaped in cross-section, defining an outwardly-facing horizontal lip 86 and a vertical section 88 which defines surface 85. Through vertical section 88, the frame bearing 84, is riveted to the carbody. Horizontal lip 86 captures and pivotally supports bearing plates 80 of frame 24.

Each frame bearing 84 is curved to mate with the curve of inner edge 82 of each bearing plate 80. Bearing plates 80 may slide on frame bearing 84. Thus, axle guard frame 24 is suspended from the car body upon frame bearings 84 and may rotate or pivot horizontally with respect to the carbody, as shown in FIG. 5 by the centerlines 87 and 89 which show the maximum pivotal movement of the axle guard frame 24 relative to the longitudinal centerline of the car.

As shown in FIG. 6, each axle guard frame 24 includes a plurality of vertical axle guard plates 26 disposed on the interior side of each longitudinal tube member 70. The reference to interior refers to the side toward the car longitudinal centerline. In the illustrated embodiment, three spaced axle guard plates 26 are disposed on each longitudinal tube 70. On each tube 70 there is a central axle guard plate 90 and two smaller side plates 92 disposed on either side of the central plate. The smaller plates are mirror images of each other, and are spaced from the central plate.

An adaptor housing 42 of one axle extends between the central plate 90 and each side plate 92. The bearing adaptor housings 42 are captured in the spaces defined between the central plate 90 and each side plate 92.

Each end plate 92 each has a wear plate 94 disposed on its inner faces, protruding slightly past its inner vertical edges. The central plate 90 has two wear plates 94 disposed on its inner face, each protruding slightly past its two vertical edges.

As shown in FIG. 12, wear plates 94 have a taper 102 at their upper ends. As the car moves laterally relative to the wheels, surfaces 41 of adaptor housings 42 engage the wear plates 94. By virtue of the tapered configuration, the point of contact between surface 41 and wear plate 94 moves vertically upwardly as flexure increases. This has the effect of shortening the fulcrum point about which the wear plates 94 bend and increases the restoring force applied to adaptor housings 42 tending to urge the carbody back to a central position relative to the suspension system.

Figure 11:
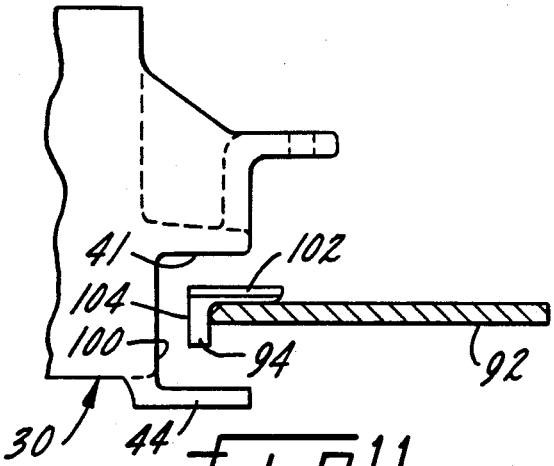
FIG. 11 is a fragmentary view, partially in section, of a portion of the apparatus of FIG. 1 taken along the line 11—11 of FIG. 2.

The wear plates 94 illustrated in FIG. 11 are located substantially below the connection of axle guards 90,92 to longitudinal tube 70, and are adapted to contact surface 41 of adaptor housing 42 during lateral movement of the carbody relative to the axles and wheels. Because the contact area is substantially below the connection to the longitudinal tube, the downwardly depending axle guard plates are cantilevered and act like springs to apply a restoring force to push the carbody back into alignment with respect to the axles.

As best seen in FIG. 11, the axle guard plates 90,92 have a large radius flange 102 welded to the top of the longitudinal tube 70. A radius angle plate 104 is attached to the axle guard plates 90,92 and to the bottom of the longitudinal tube 70. As the axle guard plates 90,92 flex, they have rolling contact with the radius angle plate 104, thereby minimizing stresses.

On the opposite side of each of the axle guard frames 24, similar axle guard plates 90,92 depend from the opposite longitudinal tube 70. The axle guard frame and axle guard plates on the opposite end of the car are the same as that described above. The mounting of the axle guard plates 90,92 on the longitudinal tubes 70 is in a manner in which the axle guards limit lateral movement of the carbody similar to the operation of the axle guards disclosed in the above-mentioned U.S. application Ser. No. 733,905. However, the axle guard frame 24 is considered unique and heretofore unknown.

The spaces defined by surfaces 41 and flanges 44 of bearing adapters 42 allow limited lateral movement without contact between the adaptor housings and the wear plates. FIG. 12 shows the relative spacing of adaptor housings 42 and each downwardly directed axle guard. The spacing depicted is the same between the axle guards defined by side plates 92 and adaptor housings 42 and axle guards defined by central plate 90 and adaptor housings 42. With all components centrally or nominally disposed, the design clearance is $\frac{5}{8}$ inch between wear plate 94 and vertical surface 41 of the adaptor housing. A similar clearance is of course present between the axle guards and adaptor housings at the opposite ends of the wheel and axle sets of each double axle suspension system. Thus the carbody, which carries with it the axle guard frame 24, may shift transversely relative to the adaptor housings 42 of the wheel and axle sets a design distance of $\frac{5}{8}$ inch before wear plates 94 of the axle guards contact the vertical surfaces 41 of the adaptor housings. Continued lateral or transverse movement causes the axle guards to begin to bend and establish a restoring force to return the axle guard frame, and consequently the carbody to its center or neutral position. Flanges 44 are a safety feature which prevents the adaptor housings 42 at an end of the wheel and axle sets from moving so far toward the opposite side sill relative to the associated axle guards so as to pass beyond wear plates 94.

Referring further to FIG. 12 there is provided a nominal or design clearance of 3/16 inch between edge 98 of each axle guard wear plate 94 and surface 100 of each adaptor housing 42. Surfaces 100 ar vertically disposed and extend parallel to the centerline of the axles 28. By virtue of the 3/16 inch clearance between surfaces 100 and the edge of each axle guard each axle can move 3/16 inch from its central or parallel position. Each axle can therefore move a total of $\frac{3}{8}$ inch from a true transverse position relative to the carbody.

The permitted shifting of the axles is accommodated by virtue of the connection of shear pad assemblies 46 to the upper surfaces of adaptor housings 42. As the wheels negotiate a curve, rail contact urges the axles toward a radial relationship with the curve, rather than a parallel relationship with each other. The elastomeric pads 47 permit the adaptor housings 42 at the inner rail of the curve to move closer together. Similarly the adaptor housings 42 at the outer rail of the curve move apart relative to each other. The movement of the adaptor housings is limited in each instance by the 3/16 inch clearance.

As illustrated in FIG. 7, when wheels 22 turn to negotiate a curved portion of track, surfaces 100 of adaptor housings 42 push against edges 98 of wear plates 94 of axle guards 90,92, and axle guard frame 24 rotates or pivots, with bearing plates 80 sliding or rotating in the channel defined by frame bearings 84 and the carbody. Similarly, when the weight of the car forces the wheels back to the neutral position, surfaces 100 of adaptor housings 42 push against edges 98 of wear plates 94 to return axle guard frame 24 to the neutral position shown in FIG. 1. Thus, axle guard plates 90,92 are operable to limit lateral movement when the car is negotiating both curved and also along straight sections of track.

As described above, double axle suspensions 16 and axle guard frames 24 are disposed under the two end sections 14 of the car. The two end sections 14 are separated from well 12 by transverse members 110 which extend between longitudinal side sills 112. The tops of transverse members 110 define flanges 113 which connect to the tops of side sills 112. Side sills 112 extend the entire length of car. As shown in FIG. 2, side sills 112 have a center section 114 extending along the well 12, a vertically narrower transition section 116 commencing at the juncture with the transverse member 110, a tapered section 118, and an end section 120 of substantially less height. Transverse support beams 122 are welded across the underside of the car body at transition sections 116 of side sills 112 and at the end of the car. Connectors 54, to which swing hangers 20 are connected, are welded to transverse support beams 122. Between transverse support beams 122 the bottoms of side sills 112 have longitudinal indentations 124 which prevent interference with axle guard frames 24 as they rotate or pivot.

Figure 9:
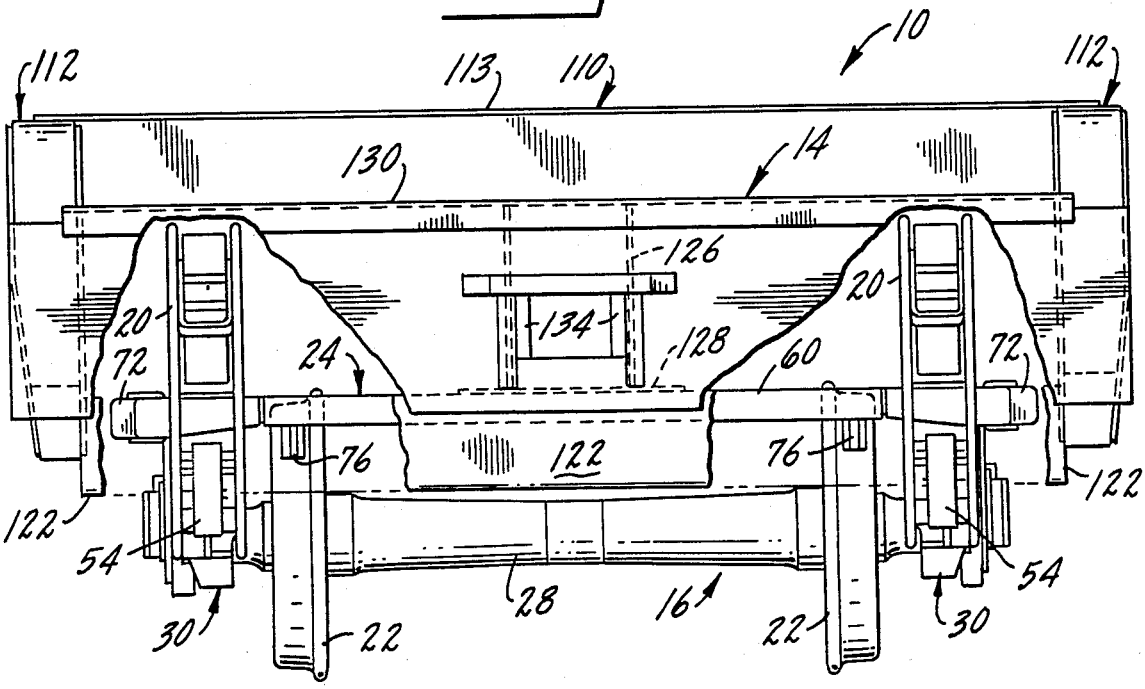
FIG. 9 is an end view of the end section of the railroad car of FIG. 1.

As shown in FIGS. 1 and 9, end sections 14 of the car body have center sills 126 extending between transverse members 110 and the ends of the car. There is no center sill in the well section of the car. The bottoms of center sills 126 have horizontal underplates 128, to which frame bearings 84 are riveted. A top shear plate 130 covers the top of each end section.

As shown in FIG. 1, the end section of the car also includes a standard draft sill 131, standard openings 132, and structures 134 in the center sill 126, to receive a standard coupler.

The railroad car of the present invention also includes damper means to dampen oscillation of the axles caused by bumps or irregularities in the track. The damper illustrated is connected, for example, as illustrated in FIG. 3 between the carbody and spring buckle 50. A pair of hydraulic dampeners 141 one of which is shown in FIG. 3 are connected between the carbody 10 and the buckles 50 of springs 18. Two such dampeners are connected to each double axle suspension system, one to each spring.

The dampeners 141 are telescopic piston and cylinder arrangements. In the illustrated embodiment, and as seen in FIG. 3 a vertical mounting plate 143 extends downwardly from the under side of the top shear plate 130 to which it is secured as by welding. Brackets 144 are welded between plate 143 and shear plate 130 to add strength. Spring buckles 50 each include an extending mounting plate or flange 145.

Cylinder 147 of dampener 141 is pivotally secured to plate 143 by cross pin 149 which is bolted to the vertical plate. Piston rod 151 is pivotally secured to buckle flange 145 by a similar pivot pin 149 which is bolted to the flange. The pivotal connections permit the dampener to function between the carbody and buckle and accommodate operational movement of the carbody relative to the spring buckle.

The dampeners 141 define a connection from the carbody directly to the wheels 22 and axles 28 through the spring buckles 50, equalizer beams 48, shear pad assemblies 46, and adaptor housings 42. Through this path the dampeners impart a stabilizing force which resists oscillatory movement of the wheels and axles and minimizes hunting of the wheel/axle combination. A representative commercial damper is Koni No. O4R-1153, a product of Koni B.V., 3260 AA Oud-Beijerland, Holland.

Figure 13:
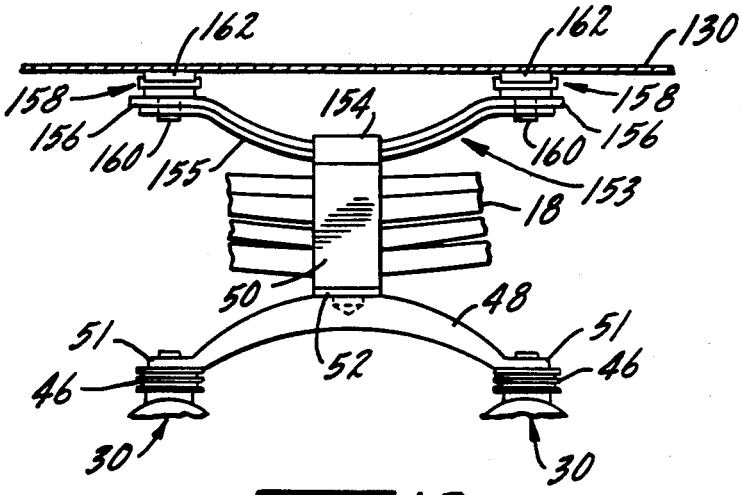
FIG. 13 is a partial view of a two axle suspension system illustrative of the principles of the present invention showing a modified form thereof.

Referring specifically to FIG. 13 there is illustrated a double axle suspension system embodying the principles of the present invention and having a modified form of dampening arrangement. In this modified form, a pair of friction dampeners, generally designated 153 are utilized to dampen wheel and axle oscillation. One such dampener is connected to each spring of the double axle suspension system.

Referring to FIG. 13, a yoke 155 extends upwardly from the buckle 50 of each spring 18 of the suspension system 16. Each includes a central connector 154 connected to the buckle 50. Yokes 155 are constructed of spring steel and are adapted to flex relative to connectors 154. They thereby accommodate any changes in relative height of the carbody to the spring buckle. This height changes with car load and as the springs move longitudinally as the car negotiates a curve.

Each end 156 of yokes 155 is provided with a friction pad assembly 158. Pad assemblies 158 include a pin 160 which is disposed in an appropriate aperture in yoke ends 156. Each assembly 158 further includes an upwardly facing friction pad or disc 162 arranged to frictionally engage the under surface of top shear plate 130. Pads or discs 162 may be made of cast iron and should provide a coefficient of friction with the under side of shear plate 130 of between 0.2 and 0.3.

The friction dampener 153 is connected to the wheels 20 and axles 28 through the same path as in the instance of the hydraulic dampener 141. The friction dampeners through the upward force imparted by yoke 155 to friction discs 162 creates frictional forces through engagement with the underside of top shear plate 130 which resists free oscillatory movement of the wheels and axles. In this way hunting of the wheel and axle sets is resisted.

By the foregoing there has been disclosed a railroad car construction which satisfies the inventive concepts set forth hereinabove. It will be understood that various additions, substitutions, modifications, and omissions may be made to the present invention as encompassed by the appended claims. Therefore, it will be understood that the present invention encompasses those additions, substitutions, modifications, and omissions provided they come within the scope of the appended claims and their equivalents.

I claim:

1. A railroad car comprising a carbody having end sections, and a pair of double axle suspension systems each supporting an end section, each including two wheel-supporting axles disposed transversely relative to their associated end section, each axle being journaled in a pair of spaced bearing adapter housings, two spaced beams bridging said axles, each beam being connected to adjacent bearing adapter housings, two spaced leaf springs disposed longitudinally relative to their associated end section, each beam being rotatably connected to an adjacent leaf spring, and two pairs of spaced swing hangers, the swing hangers of each pair being pivotally connected to respective ends of an adjacent leaf spring and also pivotally connected to said end section, and wherein said system further includes a frame rotatably connected to its associated end section, said frame having at least two spaced plates, said plates and said adjacent bearing adapter housings being oriented such that they abut to limit lateral movement of their associated end section relative to the wheels supported by said axles.

2. A railroad car comprising a carbody having end sections, and a pair of double axle suspension systems each supporting an end section, each including two-wheel-supporting axles disposed transversely relative to their associated end section, each axle being journaled in a pair of spaced bearing adapter housings, two spaced beams bridging said axles, each beam being connected to adjacent bearing adapter housings, two spaced leaf spring disposed longitudinally relative to their associated end section, each beam being rotatably connected to an adjacent leaf spring, and two pairs of spaced swing hangers, the swing hangers of each pair being pivotally connected to respective ends of an adjacent leaf spring and also pivotally connected to said end section, and wherein each system further including a frame rotatably connected to its associated end section, said frame having at least two spaced plates each disposed in the path of travel of respective adjacent bearing adapter housing as said car negotiates a curved section of track, said adjacent bearing adapter housings abut said plates on rotation of said frame relative to its associated end section as said car negotiates a curved section of track.

3. The railroad car of claim 2, wherein said plates and their respective adjacent bearing adapter housings are oriented such that they also abut to limit lateral movement of their associated end section relative to the wheels supported by said axles.

4. A double axle suspension system for supporting one end of a railroad car, said suspension system comprising two substantially parallel wheel-supporting axles each journaled in a pair of spaced bearing adapter housings, two spaced beams bridging said axles, each beam being connected at its ends to adjacent bearing housings, two spaced leaf springs, each beam being rotatably connected to an adjacent leaf spring, and two pairs of spaced swing hangers, the swing hangers of each pair being pivotally connected at one end thereof to respective ends of an adjacent leaf spring, the other end thereof being adapted for pivotal connection to the railroad car, and further comprising a frame adapted for rotatable connection to the railroad car, said frame and said adjacent bearing adapter housing being oriented such that they abut to limit relative movement therebetween in a direction substantially parallel to the axes of said axles.

5. The double axle suspension system of claim 4, wherein each of said beams is resiliently connected at its ends to said adjacent bearing adapter housings.

6. A double axle suspension system for supporting one end of a railroad car, said suspension system comprising two substantially parallel wheel-supporting axles each journaled in a pair of spaced bearing adapter housings, two spaced beams bridging said axles, each beam being connected at its ends to adjacent bearing housings, two spaced leaf springs, each beam being rotatably connected to an adjacent leaf spring, and two pairs of spaced swing hangers, the swing hangers of each pair being pivotally connected at one end thereof to respective ends of an adjacent leaf spring, the other end thereof being adapted for pivotal connection to the railroad car, and further comprising a frame adapted for rotatable connection to the railroad car, said frame being disposed in the path of travel of said adjacent bearing adapter housings as said suspension system negotiates a curved section of track, said adjacent bearing adapter housings abut said frame on rotation of said frame as said suspension system negotiates a curved section of track.

7. The double axle suspension system of claim 6, wherein said frame and said adjacent bearing adapter housings are oriented such that they also abut to limit relative movement therebetween in a direction substantially parallel to the axes of said axles.

8. The double axle suspension system of claim 7, wherein each of said beams is resiliently connected at its ends to said adjacent bearing adapter housings.

9. The double axle suspension system of claim 8, wherein each of said beams is rotatably connected at is center to the center of said adjacent leaf spring.

10. The double axle suspension system of claim 6, wherein each of said beams is resiliently connected at its ends to said adjacent bearing adapter housings.

11. A double axle suspension system comprising two substantially parallel axles each supporting a pair of spaced track-engaging wheels, each axle being journaled in a pair of spaced bearing adapter housings, a pair of spaced beams each bridging said axles, each beam being resiliently connected to adjacent bearing housings such that said axles have limited freedom for relative movement in a plane defined by them as said suspension system negotiates a curved section of track, a pair of spaced leaf springs oriented substantially perpendicular to the axes of said axles, each beam being rotatably connected to an adjacent leaf spring intermediate its ends, and two pairs of spaced swing hangers, each swing hanger being pivotally connected at one end thereof to a respective end of an adjacent leaf spring, each swing hanger also being adapted for pivotal connection at the other end thereof to an associated railroad car, a frame adapted for rotatable connection to the associated railroad car, said frame and said bearing adapter housings being oriented such that said frame is rotated by said bearing adapter housings as said suspension system negotiates a curved section of track, said bearing adapter housings also being oriented such that said bearing adapter housing limit movement of said frame in a direction parallel to the axes of said axles.

* * * * *